US005937479A

United States Patent [19]

Ohshima et al.

[11] Patent Number: 5,937,479

[45] Date of Patent: Aug. 17, 1999

[54] HINGE

[75] Inventors: Kazuyoshi Ohshima; Shinichiro Koshikawa, both of Tokyo, Japan

[73] Assignee: Sugatsune Kogyo Co., Ltd., Tokyo, Japan

[21] Appl. No.: 09/030,145

[22] Filed: Feb. 25, 1998

[30] Foreign Application Priority Data

Feb. 25, 1997 [JP] Japan ..... 9-056884
Feb. 25, 1997 [JP] Japan ..... 9-056885

[51] Int. Cl.[6] ..... E05D 7/10

[52] U.S. Cl. ..... 16/257; 16/258

[58] Field of Search ..... 16/257, 258, 259, 16/267, 254

[56] References Cited

U.S. PATENT DOCUMENTS 4,800,621 1/1989 Röck et al. .
4,800,622 1/1989 Rock et al. ..... 16/257
5,025,530 6/1991 Ferrari et al. ..... 16/258
5,056,190 10/1991 Rock et al. ..... 16/257
5,119,527 6/1992 Rock ..... 16/258
5,210,907 5/1993 Toyama ..... 16/258
5,253,390 10/1993 Gross et al. ..... 16/257

FOREIGN PATENT DOCUMENTS 3-197783 8/1991 Japan .

*Primary Examiner*—Chuck Y. Mah
*Attorney, Agent, or Firm*—Fish & Richardson P.C.

[57] ABSTRACT

Elongate holes (34, 35) are formed respectively in a front end portion and in a rear end portion of a link member (30). One pair of engagement pins (41, 42) are movably pierced through the elongate holes (34, 35), respectively. A through-hole 52 is formed in a front end portion of a control member (50), and an elongate hole (53) is formed in the rear end portion. An engagement pin (41) is pierced through the through-hole (52). The control member (50) is pivotably linked to the link member (30) through the engagement pin (41). The engagement pin (42) is movably pierced through the elongate hole (53). The elongate hole (35) is inclined at the same angle as the engagement recess (17), The elongate hole (53) is formed in a horizontal posture.

12 Claims, 7 Drawing Sheets

HINGE

FIELD OF THE INVENTION

This invention relates to a hinge for pivotably attaching a door to a body member.

BACKGROUND OF THE INVENTION

In general, hinges include a base member fixed to a body member, and a link member pivotably attached to a door, the door being pivotably linked to the body member when the link member is linked to the base member.

Hinges of this type can be classified into the following two kinds depending on a link structure for linking the link member to the base member. The hinges of the first kind are such that a link member is linked to a base member through an engagement pin fixed to one end portion of the link member, and a pivot lever provided on the other end portion of the link member (see U.S. Pat. No. 4,800,621). The hinges of the second kind are such that a link member is linked to a base member by bringing one pair of engagement pins provided on opposite end portions of the link member into engagement with the base member (see Japanese Patent Unexamined Publication (KOKAI) No. 197783/91).

In the former hinges, since the link member can be detached from the base member by operating the pivot lever to pivot the link member, the link member can easily be detached from the base member. On the other hand, it is absolutely required to bring the lever into engagement with the base member after the engagement pin is engaged with the base member when the link member is linked to the base member. Therefore, the linking procedure is primarily determined and cannot be changed. For example, it is impossible to bring the engagement pin into engagement with the base member after the lever is engaged with the base member.

In the latter hinges, even if one of the paired engagement pins is engaged with the base member first, the other engagement pin can be engaged with the base member when the link member is linked to the base member. Therefore, at least two linking procedures can be obtained. On the other hand, since a control member to which one pair of engagement pins are linked is required to be linearly moved in a longitudinal direction of the link member when the link member is detached from the hinge member, the detaching operation of the link member is rather troublesome.

The present invention provides a hinge, which hinge is of the type that a link member is linked to a base member through one pair of engagement pins, nevertheless the link member can be detached from the base member by pivoting a control member to which one pair of engagement pins are linked.

SUMMARY OF THE INVENTION

According to the present invention, there is essentially provided a hinge for pivotably attaching a door to a body member, comprising:

a base member fixed to the body member and formed in a first and a second end portion thereof with one pair of first and second engagement recesses;

a link member pivotably attached to the door;

one pair of first and second engagement pins movably provided on a first and a second end portion of the link member in a longitudinal direction for movement in directions of engagement and disengagement with respect to the one pair of engagement recesses, respectively, by disengageably engaging the one pair of engagement pins respectively with the one pair of engagement recesses, the link member being detachably linked to the base member;

a control member pivotably connected to the link member, first and second end portion of the control member being linked respectively to the one pair of engagement pins;

biasing means for biasing the one pair of engagement pins through the control member so as to be engaged in the one pair of engagement recesses;

at least the first engagement pin provided on the first end portion of the link member being movably linked to the control member for movement in directions of engagement and disengagement with respect to the first engagement recess; and at least between the first end portion of the control member and the first end portion of the link member, there being a provision of a movement mechanism for moving the first engagement pin in a direction of disengagement from the first engagement recess when the first end portion of the control member is pivoted in a direction away from the base member.

BRIEF DESCRIPTION OF THE DRAWINGS

FIG. 3(A) shows a state wherein the link member is already attached to the base member, and FIGS. 3(B)–3(D) show examples for attaching the link member to the base member, the link member being not shown in FIG. 3;

FIG. 8(A) shows a state wherein the link member is already attached to the base member, and FIGS. 8(B)–8(D) show examples for attaching the link member to the base member, respectively, the link member being not shown in FIG. 8;

DETAILED DESCRIPTION OF THE EMBODIMENTS

Embodiments of the present invention will be described hereinafter with reference to FIGS. 1 through 11.

Figure 1:
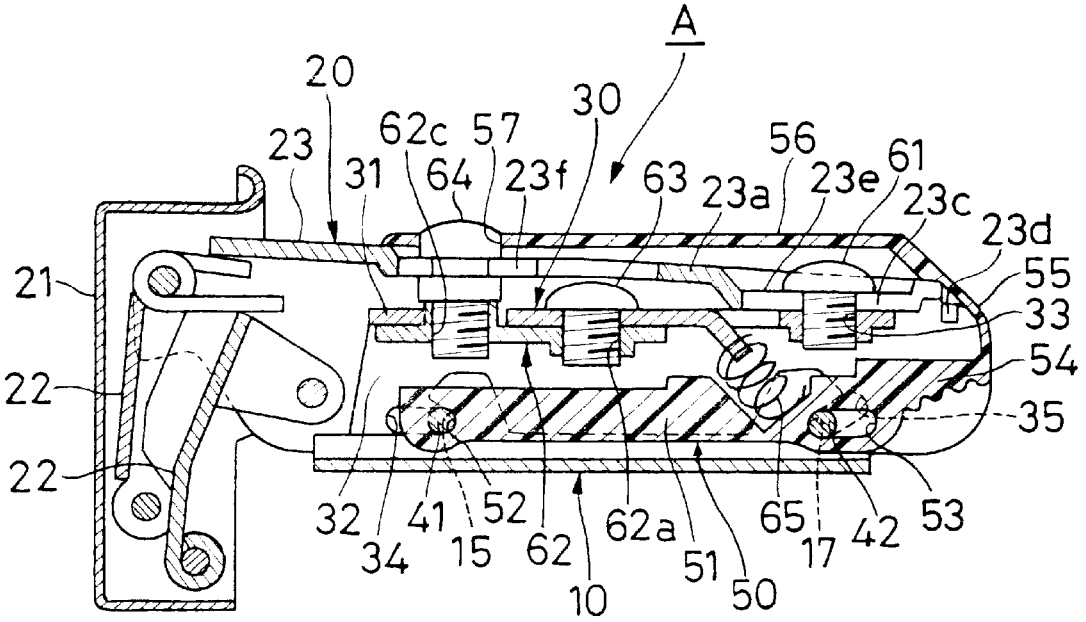
FIG. 1 is a sectional view showing one embodiment of the present invention.
Figure 2:
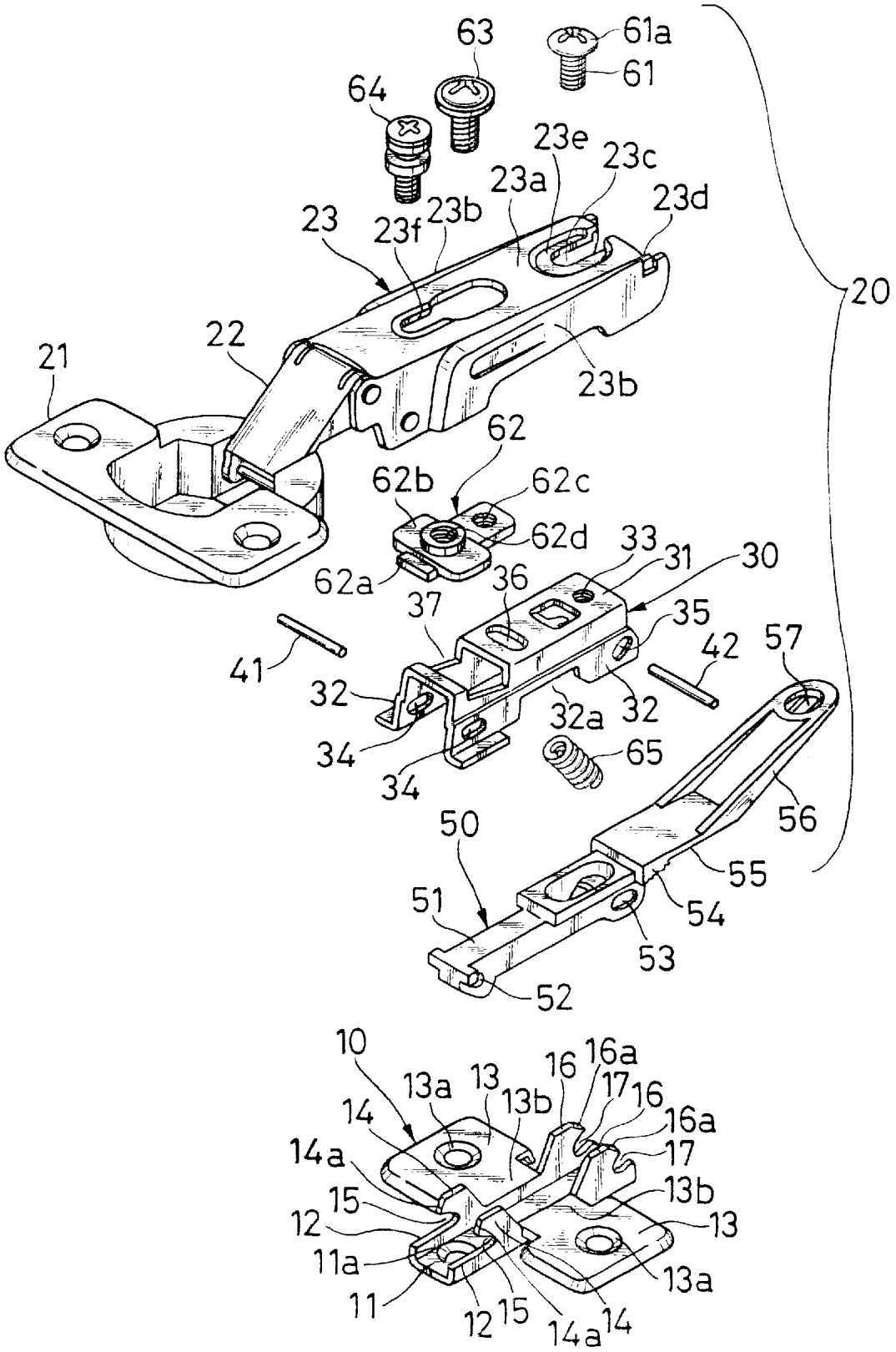
FIG. 2 is an exploded perspective view of the embodiment of FIG. 1.

Referring first to FIGS. 1 through 4, the first embodiment will be described. A hinge A of this embodiment includes, as shown in FIGS. 1 and 2, a base member 10 attachable to a body member (not shown), and a main body portion 20 attachable to a door (not shown) for opening/closing an opening portion of the body member.

The base member 10 is formed by press molding from a metal plate. The base member 10 includes a rectangular plate-like substrate portion 11, one pair of side plate portions 12, 12 erected from opposite side portions of the substrate portion 11, and stationary plate portions 13, 13 projecting sidewardly from the respective side plate portions 12. The base member 10 is placed with the longitudinal substrate portion 11 oriented in forward/back directions of the body member and fixed to an inner surface of the body member by screws (not shown) inserted into insertion holes 11*a*, 13*a* which are formed in the substrate portion 11 and the stationary plate portion 13, respectively. Accordingly, the one pair of side plate portions are in opposing relation to each other in upward/downward directions of the body member.

The side plate portions 12, 12 are formed on a forward side of forward end faces (upper end faces in FIG. 2) thereof with projections 14, 14, respectively. Each projection 14 is formed at its forwardly facing side surface with an inclined surface 14*a* which is gradually inclined forwardly towards the substrate portion 11 and also with an engagement recess 15 which is released forwardly and located at an area following the inclined surface 14*a*. This engagement recess 15 is formed in such a manner as to be oriented generally horizontally forwardly. On the other hand, projections 16, 16 are formed respectively on forward end faces (upper end faces in FIG. 2) of the side plate portions 12, 12 at rear end portions thereof. Each projection is formed with an inclined surface 16*a* which is inclined backwardly towards the substrate portion 11 and also with an engagement recess 17 which is released backwardly and located at an area following the inclined surfaces 16*a*. This engagement recess 17 is inclined backwardly away from the substrate portion 11. Each stationary plate portion 13 is formed at a basal portion thereof with a reduced width portion 13*b* which is smaller in width than a forward end side portion of the stationary plate portion 13.

The main body portion 20 comprises, as its main component elements, a cup member 21 attachable to the door, a main body member 23 pivotably linked to the cup member 21 through arms 22, a link member 30 detachably attached to the main body member 23, and a control member 50 linked to the link member 30 through engagement pins 41, 42.

The cup member 21 is fixed to the door such that the main body member 23 is pivoted in a horizontal direction. Accordingly, when the main body 20 is linked to the base member 10, the door is horizontally pivotably supported by the body member.

The main body member 23 includes a top plate portion 23*a*, and side plate portions 23*b*, 23*b* projecting from opposite side portions thereof towards the base member 10, respectively. An inner width, i.e., a distance between opposing surfaces of the side plate portions 23*b*, 23*b*, of the main body member 23 is gradually reduced from its forward end towards its rearward end.

The link member 30 includes a top plate portion 31, and side plate portions 32, 32 projecting from opposite side portions thereof towards the base member 10, respectively. The link member 30 is inserted in the main body member 23. An outer width, i.e., a distance from an outer surface of one of the opposite side plate portions 32, 32 to an outer surface of the other side plate portion 32, of the link member 30 is generally the same as the inner width of the main body member 23 at its rear end portion. According, the link member 30 can not only move forwardly/backward and leftwardly/rightwardly of the body member with respect to the main body member 23, but also pivot upwardly/downwardly of the body member about the rear end portion. In order to adjust the forward/backward and leftward/rightward position, and the upward/downward pivot position of the link member 30 with respect to the main body member 23, the following construction is employed.

That is, a bolt insertion hole 23*c* is formed in a rear end portion of the top plate portion 23*b* of the main body member 23. This bolt insertion hole 23*c* is formed as a forwardly/backwardly elongate hole and released at its rear end portion. A bolt 61 is inserted in the bolt insertion hole 23*c*. This bolt 61 is threadingly engaged with a female hole 33 formed in the top plate portion 31 of the link member 30. Accordingly, by untightening the bolt 61, the main body member 23 can be adjusted in position in a forward/backward direction to the extent of the length of the bolt insertion hole 23*c*. By this, the door can be adjusted in position in a forward/backward direction of the body member. By tightening the bolt 61 after the adjustment of position, the link member 30 can be fixed to the main body member 23.

The main body member 23 is formed on inner side surfaces of the side plate portions 23*b*, 23*b* at areas on the rear end side with lock projections 23*d*, 23*d* (only one lock projection 23*d* is shown in FIG. 2) projecting inwardly. Each lock projection 23*d* hits a rear end face of the top plate portion 31 of the link member 30 when the link member 30 is moved backwardly with respect to the main body member 23 until immediately before the bolt 61 escapes backwardly from the bolt insertion hole 23*c*. By this, the link member 30 is prevented from escaping backwardly from the main body member 23.

However, if the bolt 61 is greatly untightened and the rear end portion of the top plate portion 23 of the main body portion 23 is moved greatly away from the link member 30, it becomes impossible for the lock projection 23*d* to hit the top plate portion 31 of the link member 30. For this reason, the lock projection 23*d* becomes unable to prevent the link member 30 from escaping backwardly from the main body member 23. In order to prevent such inconveniences, the top plate portion 23*b* of the main body member 23 is formed with a bolt seat 23*e* as a recess surrounding the bolt insertion hole 23*c*. A width of this bolt seat 23*e* is generally the same as the diameter of a head portion 61*a* of the bolt 61 but a width of a rear end portion of the bolt seat 23*e* is smaller than the diameter of the head portion 61*a*. Accordingly, even in case the top plate portion 23*a* of the main body member 23 is so greatly moved away from the top plate portion 31 of the link member 30 that the lock projection 23*d* cannot hit the top plate portion 31, the head portion 61*a* hits a rear end portion of the bolt seat 23*e* when the link member 30 is moved backwardly, inasmuch as the head portion 61*a* of the bolt 61 is in contact with the bolt seat 23*e*. This can prevent the link member 30 from escaping backwardly from the main body member 23.

It may sometimes happen depending on the pivot position of the main body member 23 that the lock projection 23*d* is moved away from the top plate portion 31 of the link member 30 and the head portion 61*a* of the bolt 61 is floated from the bolt seat 23*e* to the extent of the depth of thereof. When the main body member 23 is pivoted to such a position, the lock projection 23*d* and the bolt seat 23*e* cannot prevent the link member 30 from escaping backwardly from the main body member 23. However, it hardly happens unless the main body member 23 is pivoted manually that the main body member 23 is pivoted to the above-mentioned position. Accordingly, it is almost sure that the link member 30 is prevented from escaping backwardly from the main body member 23.

The link member 30 is provided with an adjustment member 62. This adjustment member 62 comprises a vertical plate 62*a* disposed along an inner surface of the top plate portion 31 of the link member 30, and a horizontal plate 62*b* fixed to a front end portion of the vertical plate 62*a*. A width of the vertical plate 62*a* is smaller than an inner width of the link member 30. Accordingly, the vertical plate 62*a* can be adjusted in position in a width direction (upward and downward directions of the body member) of the link member 30. The vertical plate 62*a* is formed on a rear end portion thereof with a screw hole 62*c*. A bolt 63 piercing through the elongate hole 36 of the top plate portion 31 is threadingly engaged in this screw hole 62*c*. Accordingly, the vertical plate 62 can be adjusted in position in the width direction of the link member 30 by untightening the bolt 63 and fixed to the link member 30 by tightening the bolt 63.

A length of the horizontal plate 62*b* is longer than an outer width of the link member 30. Opposite end portions of the horizontal plate 62*b* are projected from the link member 30 via a notch 37 formed in the link member 30 and contacted with the opposite side plate portions 23*b*, 23*b* of the main body member 23. Accordingly, when the main body member 23 is pivoted upwardly and downwardly about its rear end portion with the bolt 63 untightened, the adjust member 62 is moved in upward/downward directions of the body member in accordance with the pivotal motion of the main body member 23. When the bolt 63 is tightened after the main body member 23 is appropriately adjusted in pivot position, the main body member 23 is fixed in position to the link member 30 by the adjustment member 62. By pivotally adjusting the main body member 23, the door is adjusted in position in upward/downward directions, and by fixing the main body member 23 to the link member 30, the door is fixed in position in upward/downward directions of the body member.

The adjustment of the door in leftward/rightward directions is performed by an adjustment screw 64 as in the conventional hinge. The adjustment screw 64 is engaged in engagement hole 23*f* formed in the top plate portion 23*a* of the main body member 23 such that the adjustment screw 64 cannot move in leftward/rightward directions but can move in forward/backward directions, and threadingly engaged in a female hole 62*d* formed in the adjustment member 62. Accordingly, when the adjustment screw 64 is turned, the main body member 23 is pivoted leftward/rightward directions of the main body member about a rear end portion thereof. By this, the door is adjusted in position in leftward/rightward directions.

The link member 30 is detachably linked to the base member 10 by the following construction.

That is, the link member 30 is formed in front end portions of the side plate portions 32, 32 with elongate holes 34, 34 extending in forward/backward directions. Opposite end portions of the engagement pin 41 are movably inserted respectively in the elongate holes 34 for movement in a longitudinal direction of the elongate holes 34. Elongate holes 35, 35 are formed respectively in the rear end portions of the side plate portions 32, 32 of the link member 30. Each elongate hole 35 is inclined such that it is gradually away from the base member 10 towards backwardly. An angle of inclination of each elongate hole 35 is set to be equal to an angle of inclination of the engagement recess 17 when the link member 30 is attached to the base member 10. Opposite end portions of the engagement pin 42 are movably inserted respectively in the elongate holes 35 for movement in the longitudinal direction of the elongate holes 35.

A control portion body 51 of a control member 50 made of a comparatively hard resin is received in the link member 30. A through-hole 52 is formed in a front end portion of this control portion body 51. The engagement pin 41 is engaged in this through-hole 52. Accordingly, the control portion body 51 is pivotable about the engagement pin 41 with respect to the link member 30 and movable in forward/backward directions to the extent of the length of the elongate hole 34.

An elongate hole 53 extending in forward/backward directions is formed in a rear end portion of the control portion body 51. The engagement pin 42 is longitudinally movably pierced through this elongate hole 53. The elongate hole 53 constitutes a positive cam mechanism for moving the engagement pin 42 in directions of engagement/disengagement from the engagement recess 17 in co-action with the elongate hole 35. When the control portion body 51 is pivoted about the engagement pin 41 in a direction away from the base member 10, the positive cam mechanism constituted by the elongate holes 35, 53 moves the engagement pin 42 backwardly in accordance with the pivotal motion. When the engagement pin 42 hits the rear end portion of the elongate hole 35 or 53, the engagement pin 42 becomes unable to move any further backwardly. By this, the range of pivotal motion of the control portion body 51 away from the base member 10 is limited. When the control portion body 51 is pivoted about the engagement pin 41 towards the base member 10, the positive cam mechanism moves the engagement pin 42 forwardly. When the engagement pin 42 hits the front end portion of the elongate hole 35 or 53, the engagement pin 42 becomes unable to move any further forwardly. By this, the range of pivotal motion of the control portion body 51 towards the base member 10 is limited.

In this hinge A, although the elongate hole 35 is inclined in forward/backward directions and the elongate hole 35 is horizontal, it is accepted that the elongate hole 35 is horizontal and the elongate hole 53 is inclined. In the alternative, both the elongate holes 35, 53 may be inclined mutually oppositely.

A spring (bias member) 65 is interposed between the control portion body 51 and the link member 30. By biasing the control portion body 51 slantwise backwardly, the spring 65 biases the control body portion 51 backwardly and also causes the control portions body 51 to perform the accessing pivotal motion. Accordingly, with no external force acting on the control portion body 51, the engagement pin 41 is located in the rear end portion of the elongate hole 34 and the engagement pin 42 is located in the front end portions of the elongate holes 35, 53. Instead of using the spring 65, two springs, one for biasing the control portion body 51 backwardly and the other for biasing the control portion body 51 towards the base member 10 may be used.

A control piece portion 54, a reduced thickness portion 55, and a cover portion 56 are formed on the rear end portion of the control portion body 51 in order. The control piece portion 54 has a stepped surface on the side of the base member 10. With a finger placed on this stepped surface, the control portion body 54 is pivoted away from the base member 10. The reduced thickness portion 55 is soft. When this reduced thickness portion 55 is curved about 180 degrees, the cover portion 56 extends along the top plate portion 23*a* of the main body member 23 to cover the bolts 61, 63 and the adjustment screw 64. Then, by fitting a fit hole 57 formed in a forward end portion of the cover portion 56 to the control screw 64, the cover portion 56 is detachably attached to the top plate portion 23*a*.

Figure 3:
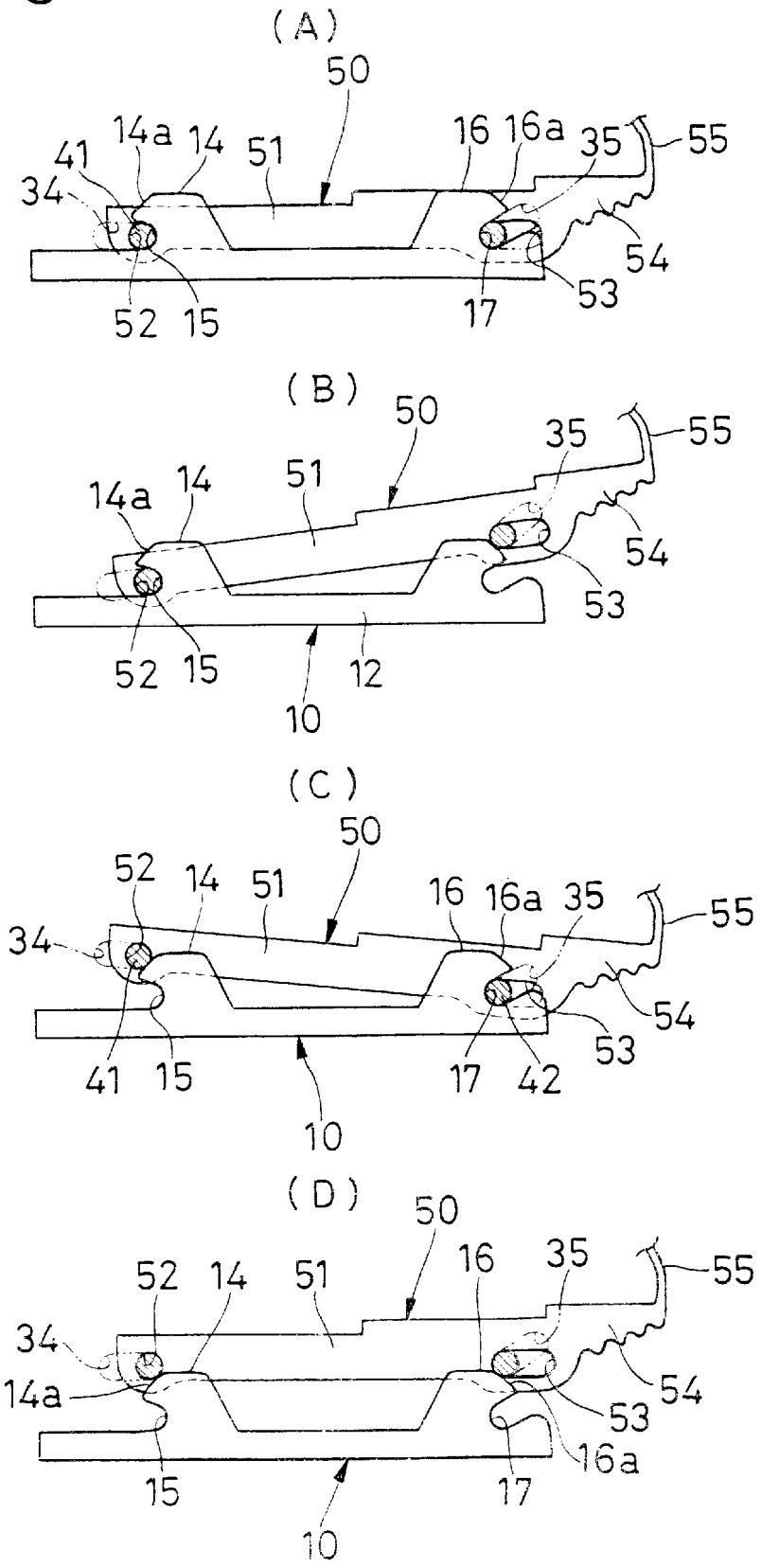
FIGS. 3(A)–3(D) are views for explaining a process for attaching a link member in the embodiment of FIG. 1 to a base member.

An arrangement in which the main body portion 20 of the hinge A thus constructed is attached to and detached from the base member 10 will be described with reference to FIG. 3. Of all the component elements of the hinge A, only the base member 10, the engagement pins 41, 42, and the control member 50 are shown in FIG. 3 and all other component elements are omitted.

For linking the main body portion 20 to the base member 10, three processes may be employed.

In the first linking process, as shown in FIG. 3(B), the front side engagement pin 41 is preliminarily engaged in the engagement recess 15. In that case, the main body member 23 (link member 30) is pivoted about the engagement pin 41 towards the base member 10 to cause the engagement pin 42 to hit the inclined surface 16*a*. In that state, when the link member 30 is further pivoted, the engagement pin 42 is caused to move backwardly within the elongate holes 35, 53 by the inclined surface 16*a*. By this, the control portion body 51 is pivoted away from the base member 10. The engagement pin 42 climbs over the inclined surface 16*a* and comes into opposing relation with the engagement recess 17. Then, the control portion body 51 is caused to pivot towards the base member 10 under the effect of the spring 65. When the control portion body 51 is pivoted towards the base member 10, the engagement pin 42 is caused to move forwardly by the elongate holes 35, 53 and fitted into the engagement recess 17 as shown in FIG. 3(A). With the engagement pins 41, 42 engaged respectively in the engagement recesses 15, 17, the link member 30 is linked to the base member 10.

With the engagement pins 41, 42 engaged respectively in the engagement recesses 15, 17, lock recesses 32*a* formed respectively in central portions of the opposite side portions 32, 32 of the link member 30 are fitted in the reduced width portion 13*b* of the base member 10. By this, since the link member 30 is linked to the base member 10 such that the link member 30 cannot move in the forward/backward directions, it never occurs that the engagement pins 41, 42 escape from the engagement recesses 15, 17, respectively. Accordingly, the link member 30 is positively linked to the base member 10.

In the second linking process, as shown in FIG. 3(C), the engagement pin 42 is preliminarily engaged in the engagement recess 17. In that case, the link member 30 is pivoted about the engagement pin 42 such that the front end portion of the link member 30 accesses the base member 10, thereby causing the engagement pin 41 to hit the inclined surface 14*a*. When the link member 30 is further pivoted in that state, the engagement pin 41 is moved forwardly within the elongate hole 34 by the inclined surface 14*a* and the control portion body 51 is moved forwardly together with the engagement pin 41 against the effect of the spring 65. At that time, since the engagement pin 42 is prohibited from moving forwardly by the engagement recess 17, the engagement pin 42 does not move forwardly together with the control portion body 51. Instead, the engagement pin 42 merely moves relatively backwardly within the elongate holes 35, 53. When the engagement pin 42 climbs over the inclined surface 14*a* and comes into opposing relation with the engagement recess 15, the control member 50 and the engagement pin 41 are moved backwardly by the spring 65 and the engagement pin 41 is fitted into the engagement recess 15. By this, the link member 30 is linked to the base member 10.

The third linking process is suitable to a case wherein the door is preliminarily linked to the body member by other hinges. In this process, the link member 30 is pivoted towards the base member 10 to cause the engagement pins 41, 42 to hit the inclined surfaces 14*a*, 16*a*, respectively, as shown in FIG. 3(D). In that state, the link member 30 is pivoted such that the front end portion or the rear end portion of the link member 30 accesses the base member 10. When the engagement pin 41 or 42 is caused to climb over the inclined surfaces 14*a* or 16*a* by the pivotal motion of the link member 30, the pins 41 or 42 comes into engagement with the engagement recess 15 or 17. Then, the link member 30 is pivoted such that the other end portion of the link member 30 accesses the base member 10, so that the engagement pin 42 or 41 comes into engagement with the engagement recess 17 or 15.

For detaching the link member 30 from the base member 10, one of the following three detaching processes can be employed.

The first detaching process is a process for pivoting the control portion body 51 away from the base member 10. When the control portion body 51 is pivoted away from the base member 10, the engagement pin 42 is moved backwardly along the engagement recess 17 under the cam effect of the elongate holes 35, 53 and escaped from the engagement recess 17. Thereafter, the link member 30 is moved forwardly to cause the engagement pin 41 to escape from the engagement recess 15. In doing so, the link member 30 can be detached from the base member 10.

The second detaching process is a process for moving the control portion body 51 forwardly. In this process, firstly, the control portion body 51 is moved forwardly to cause the engagement pin 41 to move forwardly along the elongate hole 34 and escape from the engagement recess 15. Then, while maintaining the foregoing state, the link member 30 is pivoted such that the front end portion of the link member 30 is brought away from the base member 10. Thereafter, the link member 30 is moved backwardly along the engagement recess 17 and the engagement pin 42 is pulled out of the engagement recess 17. By this, the link member 30 can be detached from the base member 10.

The third detaching process is a combination of the first and second detaching processes. In this process, firstly, by bringing the control portion body 51 away from the base member 10, the engagement pin 42 is disengaged from the engagement recess 17. Thereafter, by moving the control portion body 51 forwardly, the engagement pin 41 is disengaged from the engagement recess 15. As a consequence, as shown in FIG. 3(D), since the engagement pins 41, 42 are disengaged from the engagement recesses 15, 17, respectively, the link member 30 can be detached from the base member 10 while maintaining the posture at the time it is attached.

It should be noted, however, that, for carrying out the third detaching process, the length of the elongate hole 53 is set long enough so that the engagement pin 42 will not hit the rear end portion of the elongate hole 53 when the control portion body 51 is pivoted, so that only the control portion body 51 and the engagement pin 41 can be moved forwardly without moving the engagement pin 42 forwardly after pivoting the control portion body 51 in accordance with the first process.

In the above-mentioned hinge A, the engagement pins 41, 42 are not simultaneously moved in the same direction. Therefore, when one engagement pin 42 (41) is brought into engagement with its corresponding engagement recess 17 (15) with the other engagement pin 41 (42) engaged with its corresponding engagement recess 15 (17), the other engagement pin 41 (42) is not disengaged from the engagement recess 15 (17). Accordingly, the link member 30 can be linked to the base member 10 positively.

In this hinge A, it can be prevented that the link member 30 is accidentally escaped from the base member 10 due to pivotal motion of the control body portion 51 away from the base member 10 by unexpected accident such as, for example, a thing hits the control piece portion 54 of the control member 50.

That is, for detaching the link member 30, the control portion body 51 is pivoted away from the base member 10 with the control piece portion 54 of the control member 50 and the cover portion 56 (the main body portion 23 in case the cover portion 56 is detached from the main body portion 23) pinched between two fingers. In doing so, the link member 30 can be detached from the base member 10 easily. However, in case an external force is acted only on the control piece portion 54 by unexpected accident, the control portion body 51 can be prevented from pivoting away from the base member 10.

Figure 4:
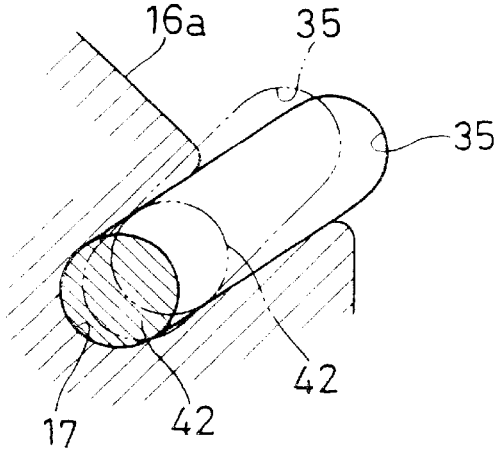
FIG. 4 is an enlarged sectional view showing a relation among an engagement pin and an engagement recess on a rear end side and an elongate hole of a link member when a control member is operated in a direction away from the base member.

For the sake of convenience of explanation, the case wherein an external force acts only on the control portion body 51 will be described first. When the control portion body 51 is pivoted away from the base member 10 by an external force, the engagement pin 42 is moved backwardly along the engagement recess 17 under the effect of cam action of the elongate holes 35, 53. At that time, since the link member 30 is pivoted in accordance with the pivotal motion of the control portion body 51, the angle of inclination of the elongate hole 35 is varied to the extent of the pivotal motion of the control portion body 51. For this reason, as shown in FIG. 4, the angle of inclination of the elongate hole 35 and the angle of the engagement recess 17 become different from each other. As a consequence, the engagement pin 42 becomes unable to move within the engagement recess 17, thus prohibiting the control portion body 51 from pivoting any further away from the base member 10. Thus, the engagement pin 42 can be prevented from disengaged from the engagement recess 17, and therefore, the link member 30 can be prevented from escaping from the base member 10 by unexpected accident.

On the other hand, in case the control portion body 51 is pivoted away from the base member 10 with the control piece portion 54 of the control member 50 and the cover portion 56 pinched between two fingers, the angle of inclination of the elongate hole 35 is varied from the angle of inclination of the engagement recess 17 to the extent of pivotal motion of the control portion body 51 away from the base member 10. However, in case the control portion body 51 is pivoted away from the base member 10 with two fingers, the link member 30 can be pivoted towards the base member 10 to the extent of the pivotal motion of the control portion body 51 away from the base member 10. This makes it possible to offset the difference in angle of inclination between the elongate hole 35 and the engagement recess 17 caused by the pivotal motion of the control portion body 51 away from the base member 10. Accordingly, the engagement pin 42 can be pulled out of the engagement recess 17 smoothly. Thus, the link member 30 can be detached from the base member 10 easily.

Next, other embodiments of the present invention will be described. In the embodiments to be described hereinafter, only the construction different from the above embodiment is described. Identical component portions are denoted by identical reference numeral and description thereof is omitted.

Figure 5:
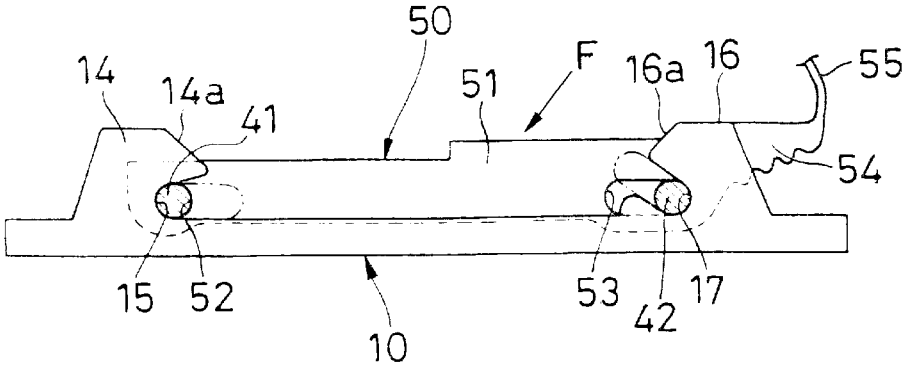
FIG. 5 is a view showing a main portion a modified example of the embodiment of FIG. 1.

In the embodiment shown in FIG. 5, the arrangement in which the engagement recesses 15, 17 of the base member 10 are opposite to each other is the same as the above embodiment, but the releasing portions thereof are in opposing relation. In correspondence with this, the elongate hole 35 of the link member 30 is inclined such that the elongate hole 35 is away from the base member 10 forwardly and the inclined surfaces 14*a*, 16*a* are inclined in a reverse direction to that of the above embodiment. A biasing force F of the spring 65 acts on the control portion body 51 slantwise forwardly as indicated by an arrow of FIG. 5. Accordingly, when the link member 30 is linked to the base portion 10, the engagement pin 41 is located in the front end portion of the elongate hole 34 and the engagement pin 42 is located in the rear end portion of the elongate hole 35. In case the link member 30 is attached to or detached from the base member 10 in this embodiment, the engagement pins 41, 42 are moved in the opposite direction to the hinge A. All the other respects are same as the hinge A.

Figure 6:
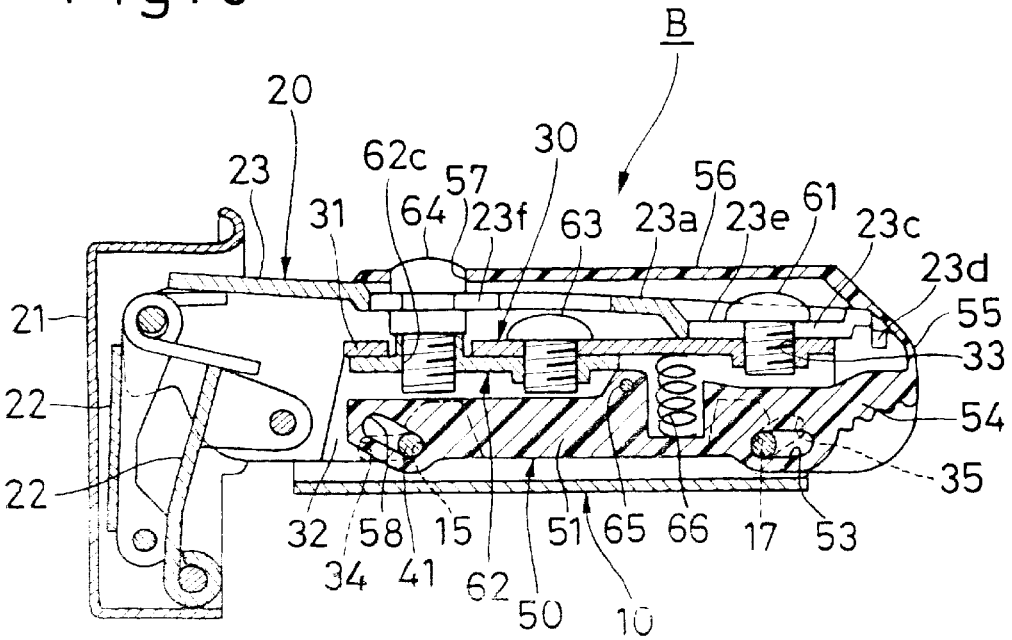
FIG. 6 is a sectional view showing another embodiment of the present invention.
Figure 7:
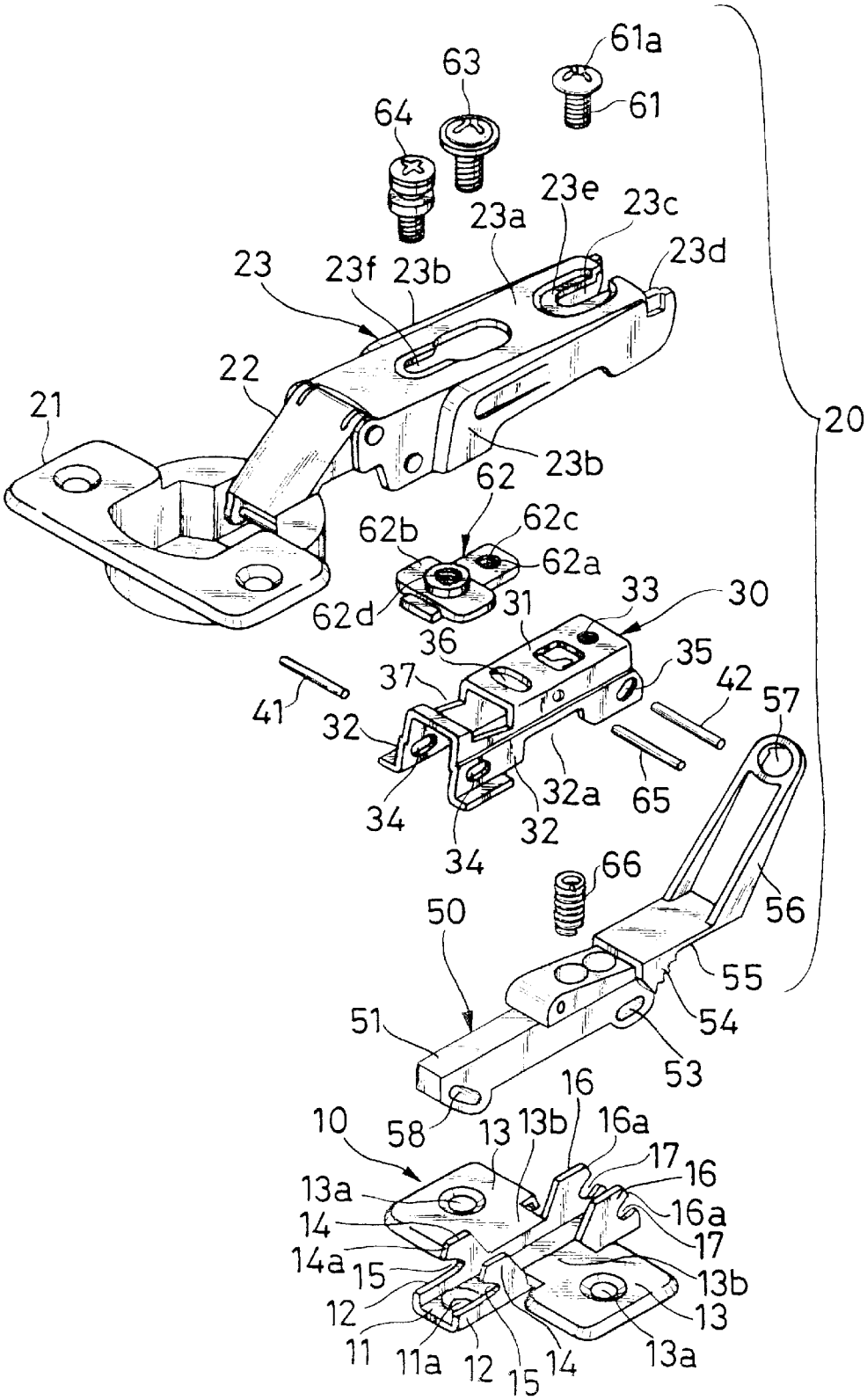
FIG. 7 is an exploded perspective view of the embodiment of FIG. 6.
Figure 8:
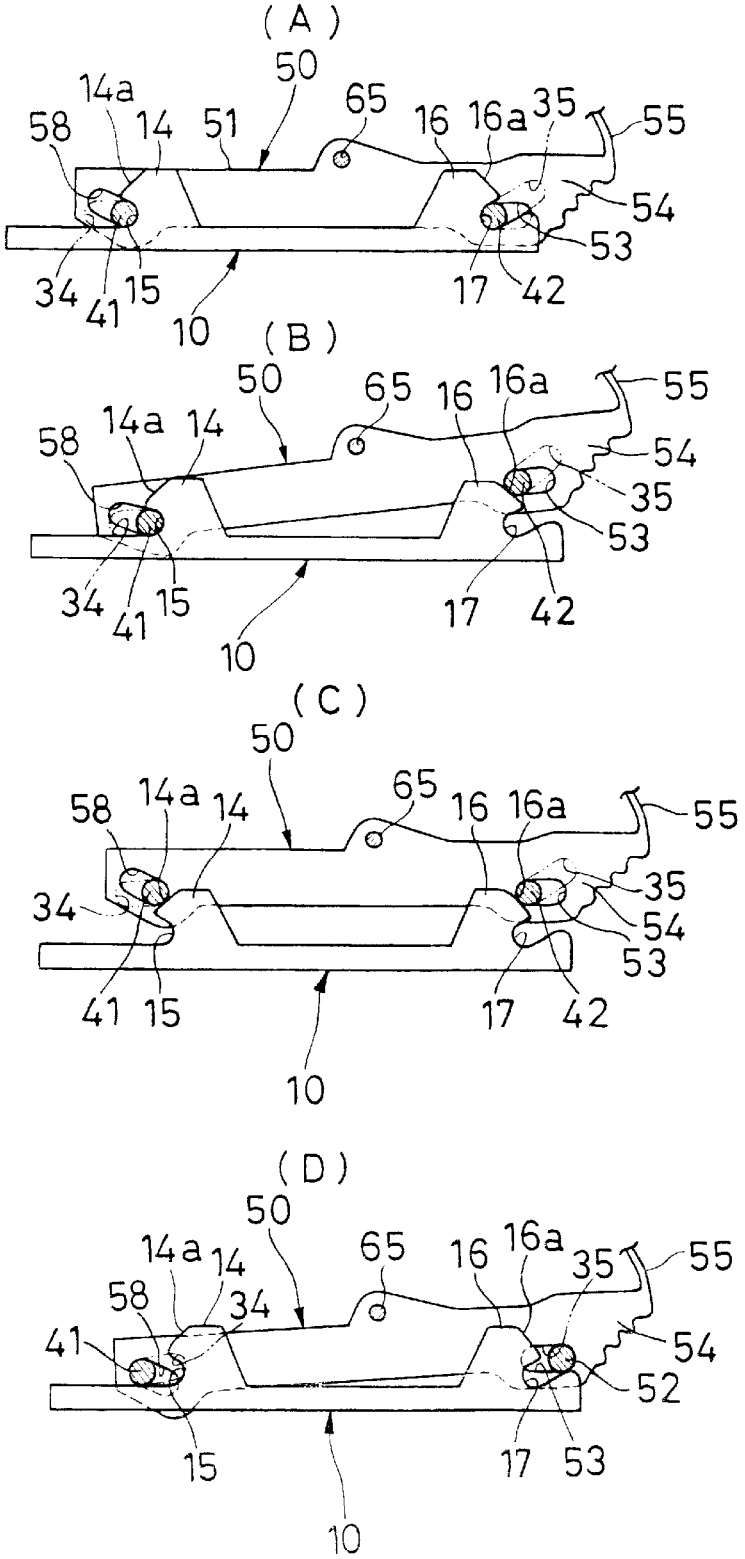
FIGS. 8(A)–8(D) are views for explaining a process for attaching a link member in the embodiment of FIG. 1 to a base member.

FIGS. 6 through 8 show other embodiments of the present invention. In this hinge B, an intermediate portion of the control portion body 51 is pivotably supported by an intermediate portion of the link member 30 through a support pin 65. Moreover, since the support pin 65 is fixed in position at the link member 30, the control portion body 51 is unmovable relative to the link member 30.

Instead of the through-hole 52 of the hinge A, an elongate hole 58 is formed in a front end portion of the control portion body 51. The engagement pin 41 is inserted in this elongate hole 58 for movement in the longitudinal direction of the elongate hole 58. The elongate hole 58 constitutes a positive cam mechanism together with the elongate hole 34 formed in the link member 30. The elongate hole 58 is inclined forwardly away from the base member 10. Accordingly, when the control portion body 51 is pivoted with respect to the link member 30, the engagement pin 41 is moved by the two elongate holes 34, 58 in directions of engagement to and disengagement from the engagement recess 15. The direction of movement of the engagement pin 41 caused by pivotal motion of the control portion body 51 is opposite to the direction of movement of the engagement pin 42. That is, when the control portion body 51 is pivoted clockwise in FIG. 8(A), the engagement pin 42 is moved forwardly but the engagement pin 41 is moved backwardly. When the control portion body 51 is pivoted counterclockwise, the engagement pin 42 is moved backwardly but the engagement pin 41 is moved forwardly. The range of pivotal motion of the control portion body 51 is limited by the engagement pin 41 hitting an end portion of the elongate hole 34 or 58, or the engagement pin 42 hitting an end portion of the elongate hole 35, or 53.

With respect to the elongate holes 34, 58, it is accepted that the elongate hole 34 is inclined and the elongate hole 58 is in a horizontal posture, or both the elongate holes 34, 58 are inclined opposite to each other inasmuch as they satisfy the condition that when the control portion body 51 is pivoted, the elongate holes 34, 58 cause the engagement pin 41 to move in a direction opposite to the direction towards which the elongate holes 35, 53 cause the engagement pin 42 to move.

A spring (biasing means) 66 is interposed between the control portion body 51 and the link member 30. This spring 66 biases the control portion body 51 such that a rear end portion of the control portion body 51 approaches the base member 10. Accordingly, inasmuch as no external force acts on the control portion body 51, the engagement pin 41 is located in the rear end portions of the elongate holes 34, 58 and the engagement pin 42 is located in the forward end portions of the elongate holes 35, 53.

Next, an arrangement in which the main body portion 20 of the hinge B thus constructed is attached to and detached from the base member 10 will be described with reference to FIG. 8. For the sake of convenience of explanation, only the base member 10, the engagement pins 41, 42, and the control member 50 are shown in FIG. 8 and other component portions are omitted therefrom.

As shown in FIG. 8(B), in case the front side engagement pin 41 is preliminarily engaged in the engagement recess 15, the main body member 23 (link member 30) is pivoted such that its rear end portion approaches the base member 10 to cause the engagement pin 42 to hit the inclined surface 16*a*. In that state, when the link member 30 is further pivoted, the engagement pin 42 is moved backwardly by the inclined surface 16*a*. As the engagement pin 42 moves backwardly, the control portion body 51 is pivoted counterclockwise with respect to the link member 30. When the engagement pin 42 is brought into opposing relation with the engagement recess 17 after climbing over the inclined surface 16*a*, the control portion body 51 is pivoted clockwise by the biasing force of the spring 66 and the engagement pin 42 is fitted in the engagement recess 17 as shown in FIG. 8(A). As a consequence, both the engagement pins 41, 42 are engaged respectively with the engagement recesses 15, 17, and the link member 30 (main body portion 23) is linked to the base member 10.

In contrast, in case the rear side engagement pin 42 is preliminarily engaged with the engagement recess 17, the link member 30 is pivoted such that its front end portion approaches the base member 10 to cause the engagement pin 41 to hit the inclined surface 14*a*. When the link member 30 is further pivoted in that state, the engagement pin 41 is moved forwardly by the inclined surface 14*a*. As the engagement pin 41 is moved forwardly, the control portion body 51 is pivoted counterclockwise with respect to the link member 30. When the engagement pin 42 is brought into opposing relation with the engagement recess 15 after climbing over the inclined surface 14*a*, the control portion body 51 is pivoted clockwise by the spring 66 to cause the engagement pin 41 to be fitted into the engagement recess 15. By this, the link member 30 is linked to the base member 10.

In case the door is preliminarily linked to the body member by other hinges, the link member 30 is pivoted towards the base member 10 to cause the engagement pins 41, 42 to hit the inclined surfaces 14*a*, 16*a*, respectively, as shown in FIG. 8(C). When the link member 30 is further pivoted in that state, the engagement pin 41 is moved forwardly by the inclined surface 14*a* and the engagement pin 42 is moved backwardly by the inclined surface 16*a*. As the engagement pins 41, 42 are moved, the control portion body 51 is pivoted counterclockwise with respect to the link member 30. When the engagement pins 41, 42 are brought into opposing relation with the engagement recesses 15, 17 after climbing over the inclined surfaces 14*a*, 16*a*, the control portion body 51 is pivoted clockwise by the spring 66 to cause the engagement pins 41, 42 to be engaged with the engagement recesses 15, 17, respectively.

For detaching the link member 30 from the base member 10, the control portion body 51 is pivoted clockwise. Then, the engagement pin 41 is moved forwardly along the engagement recess 15 under the effect of cam action of the elongate holes 34, 58, and the engagement pin 42 is moved backwardly along the engagement recess 17 under the effect of cam action of the elongate holes 35, 53. As shown in FIG. 8(D), when both the engagement pins 41, 42 are disengaged respectively from the engagement recesses 15, 17, the engagement of the link member 30 with respect to the base member 10 is canceled by the engagement pins 41, 42 and therefore, the link member 30 (main body portion 20) can be detached from the base member 10 easily.

Figure 9:
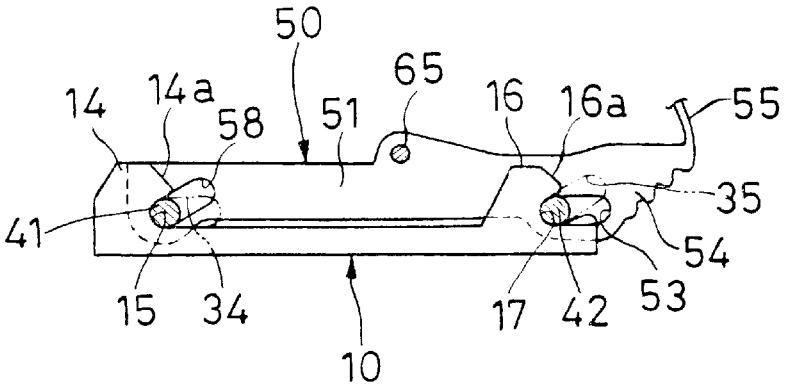
FIG. 9 is a view showing a main portion of the first modified example of the embodiment of FIG. 6.

FIG. 9 shows the first modified example of the hinge B. In this modified example, the engagement recess 15 of the base member 10 is oriented backwardly. In correspondence with this, the elongate hole 58 is inclined backwardly away from the base member 10. Accordingly, when the control portion body 51 is pivoted, the engagement pins 41, 42 are moved in the same direction.

In this modified example, when the control portion body 51 is pivoted clockwise, the engagement pins 41, 42 are moved forwardly and engaged respectively with the engagement recesses 15, 17, and when the control portion body 51 is pivoted counterclockwise, the engagement pins 41, 42 are moved backwardly and disengaged respectively from the engagement recesses 15, 17.

Figure 10:
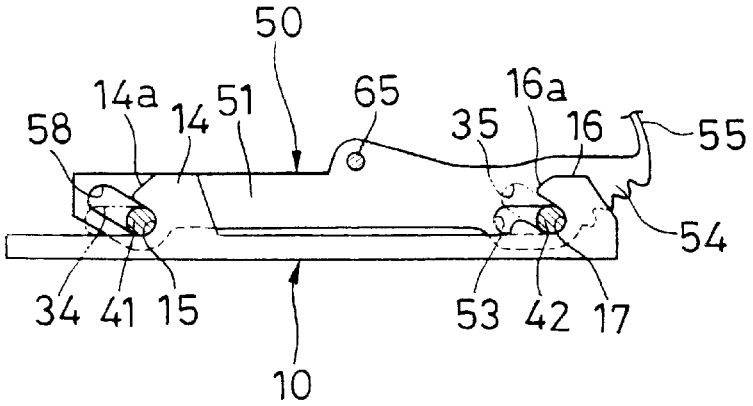
FIG. 10 is a view showing a main portion of the second modified example of the embodiment of FIG. 6.

FIG. 10 shows the second modified example of the hinge B. In this modified example, the engagement recess 17 of the base member 10 is oriented forwardly. In correspondence to this, the elongate hole 35 is inclined forwardly away from the base member 10. Accordingly, when the control portion body 51 is pivoted, the engagement pins 41, 42 are moved in the same direction.

In this modified example, when the control portion body 51 is pivoted clockwise, the engagement pins 41, 42 are moved backwardly and engaged respectively with the engagement recesses 15, 17, and when the control portion body 51 is pivoted counterclockwise, the engagement pins 41, 42 are moved forwardly and disengaged respectively from the engagement recesses 15, 17.

Figure 11:
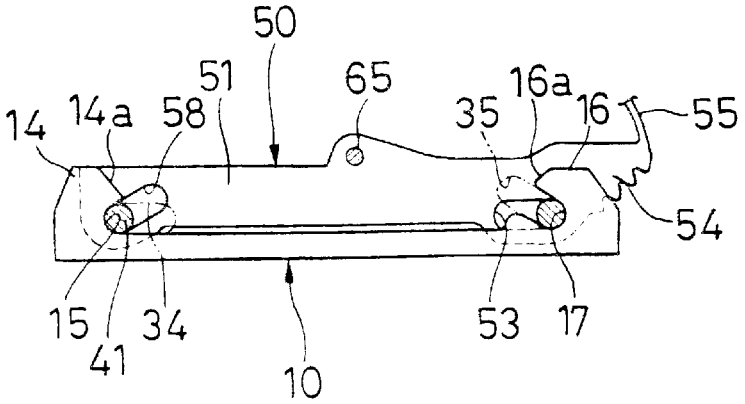
FIG. 11 is a view showing a main portion of the third modified example of the embodiment of FIG. 6.

FIG. 11 shows the third modified example of the hinge B. In this modified example, the engagement recesses 15, 17 of the base member 10 are formed in a reversed manner so that they are in opposing relation. In correspondence with this, the elongate hole 58 is inclined backwardly away from the base member 10 and the elongate hole 35 is inclined forwardly away from the base member 10. Accordingly, the engagement pins 41, 42 are moved in opposite directions when the control portion body 51 is pivoted.

In this modified example, when the control portion body 51 is pivoted clockwise, the engagement pin 41 is moved forwardly and engaged with the engagement recess 15 and the engagement pin 42 is moved backwardly and engaged with the engagement recess 17. When the control portion body 51 is pivoted counterclockwise, the engagement pin 41 is moved backwardly and disengaged from the engagement recess 15, and the engagement pin 42 is moved forwardly and disengaged from the engagement recess 17.

What is claimed is:

1. A hinge for pivotally connecting a door to a body member, comprising:

a base member attachable to said body member, the base member having a first and a second end portion, the first and second end portions having a pair of first and second engagement recesses, respectively;

a main body member pivotally attachable to said door;

a link member positioned within said main body member, the link member having a first and a second end portion;

a first and a second engagement pin movably coupled to said first and second end portions of said link member, respectively, the engagement pins being configured to engage said engagement recesses;

a control member pivotally connected to said link member, the control member having first and second end portions coupled to said first and second engagement pins, respectively;

a biasing member disposed between the link member and the control member, the biasing member arranged to bias said engagement pins into engagement with said engagement recesses;

said first engagement pin being movably coupled to said control member for movement in directions to engage or disengage said first engagement recess; and a first cam mechanism provided at said first end portion of said control member and said first end portion of said link member, said first cam mechanism being configured to disengage said first engagement pin from said first engagement recess when said first end portion of said control member is pivoted away from said base member.

2. A hinge according to claim 1, wherein:

said base member includes inclined surfaces continuous with said engagement recesses; and said engagement pins are configured to roll over said inclined surfaces to engage said engagement recesses.

3. A hinge according to claim 1, wherein said second engagement pin is fixed to said second end portion of said control member such that said control member and said second engagement pin move together relative to said link member.

4. A hinge according to claim 1, wherein said first cam mechanism includes two elongated holes formed in each of said first end portion of said link member and said first end portion of said control member, said first engagement pin being inserted into said elongated holes and said elongated holes being mutually inclined such that said first engagement pin is disengaged from said first engagement recesses when said first end portion of said control member is pivoted away from said base member about said second engagement pin.

5. A hinge according to claim 4, wherein said first engagement recesses are inclined at the same angle as said elongated holes in said first end portion of said link member.

6. A hinge according to claim 1, wherein said first and second engagement recesses are formed with releasing portions oriented in directions away from each other.

7. A hinge according to claim 1, wherein said first and second engagement recesses are formed with releasing portions oriented in directions towards each other.

8. A hinge according to claim 1, wherein a second cam mechanism is provided at said second end portion of said link member and said second end portion of said control member for moving said second engagement pin to engage or disengage said second engagement recesses when said control member is pivoted.

9. A hinge according to claim 8, wherein:

said base member includes inclined surfaces continuous with said engagement recesses; and said engagement pins are configured to roll over said inclined surfaces to engage said engagement recesses.

10. A hinge according to claim 9, wherein:

said second cam mechanism includes a second pair of elongated holes formed in each of said second end portions of said link member and said control member; and said second engagement pin is inserted into said second pair of elongated holes, said second pair of elongated holes being mutually inclined such that said second engagement pin is disengaged from said second engagement recesses when said second end portion of said control member is pivoted away from said base member.

11. A hinge according to claim 8, wherein said first and second engagement recesses are formed with releasing portions oriented in directions away from each other.

12. A hinge according to claim 8, wherein said first and second engagement recesses are formed with releasing portions oriented in a direction towards each other.

* * * * *

UNITED STATES PATENT AND TRADEMARK OFFICE

CERTIFICATE OF CORRECTION

PATENT NO. : 5,937,479

DATED : August 17, 1999

INVENTOR(S) : Kazuyoshi OHSHIMA, et al.

It is certified that error appears in the above-identified patent and that said Letters Patent is hereby corrected as shown below:

Claim 10, line 1, change "according to claim 9" to --according to claim 8--.

Signed and Sealed this

Eighth Day of February, 2000

*Attest:*

*Attesting Officer*

Q. TODD DICKINSON

*Commissioner of Patents and Trademarks*